US007907700B2

(12) United States Patent
Inaba et al.

(10) Patent No.: US 7,907,700 B2
(45) Date of Patent: Mar. 15, 2011

(54) SOFT X-RAY GENERATION APPARATUS AND STATIC ELIMINATION APPARATUS

(75) Inventors: Hitoshi Inaba, Tokyo (JP); Yoshinori Okubo, Tokyo (JP); Yoshiyuki Yagi, Tokyo (JP); Shunichi Sato, Kawagoe (JP); Kazuhito Nishimura, Nankoku (JP)

(73) Assignees: Casio Computer Co., Ltd., Tokyo (JP); Kochi Industrial Promotion Center, Kochi-Shi (JP)

( * ) Notice: Subject to any disclaimer, the term of this patent is extended or adjusted under 35 U.S.C. 154(b) by 234 days.

(21) Appl. No.: 12/226,077

(22) PCT Filed: Apr. 10, 2007

(86) PCT No.: PCT/JP2007/057890

§ 371 (c)(1),
(2), (4) Date: Oct. 7, 2008

(87) PCT Pub. No.: WO2007/119715

PCT Pub. Date: Oct. 25, 2007

(65) Prior Publication Data

US 2009/0272915 A1 Nov. 5, 2009

(30) Foreign Application Priority Data

Apr. 11, 2006 (JP) ..... 2006-108775
Nov. 1, 2006 (JP) ..... 2006-298043

(51) Int. Cl.
*H01J 35/00* (2006.01)

(52) U.S. Cl. ..... 378/122; 378/136

(58) Field of Classification Search ..... 378/122, 378/119, 124, 143, 136; 313/306, 495, 309
See application file for complete search history.

(56) References Cited

U.S. PATENT DOCUMENTS

2006/0261719 A1* 11/2006 Fox ..... 313/311
2008/0267354 A1* 10/2008 Holm et al. ..... 378/122

FOREIGN PATENT DOCUMENTS

| | | | |
|---|---|---|---|
| JP | 02-267844 | A | 11/1990 |
| JP | 07-211273 | A | 8/1995 |
| JP | 2749202 | B2 | 2/1998 |
| JP | 2001-035427 | A | 2/2001 |
| JP | 2001-266780 | A | 9/2001 |
| JP | 2004-144647 | A | 5/2004 |
| JP | 2005-116354 | A | 4/2005 |
| JP | 2006-125881 | A | 5/2006 |
| JP | 2006-179457 | A | 7/2006 |
| WO | WO 94/05138 | A1 | 3/1994 |

* cited by examiner

*Primary Examiner* — Hoon Song
(74) *Attorney, Agent, or Firm* — Holtz, Holtz, Goodman & Chick, PC

(57) ABSTRACT

The present invention aims to suppress calorific value and prolong a lifetime of an apparatus that generates soft X-rays. Thus, the present invention provides a static elimination apparatus that includes an emitter as an electron emitting portion and a target, in which a thin film formed of diamond particles each having a particle size of 2 nm to 100 nm is formed on a surface of the emitter. The thin film has a diamond XRD pattern in an XRD measurement and, in a Raman spectroscopic measurement, a ratio of an sp3 bonding component to an sp2 bonding component within the film of 2.5 to 2.7:1. When a DC voltage is applied to the emitter, with a threshold electric field intensity of 1 V/μm or less, electrons larger in number than the prior art are emitted from the emitter and moreover, a temperature of the emitter is hardly increased, thus obtaining a longer lifetime.

16 Claims, 7 Drawing Sheets

SOFT X-RAY GENERATION APPARATUS AND STATIC ELIMINATION APPARATUS

This application is a U.S. National Phase Application under 35 USC 371 of International Application PCT/JP2007/057890 filed Apr. 10, 2007.

TECHNICAL FIELD

The present invention relates to a soft X-ray generation apparatus and a static elimination apparatus for removing static electricity from a charged object.

BACKGROUND ART

In production apparatuses and production lines of semiconductor devices, FPD glass substrates, and other electronic components, for example, the electronic components or substrates thereof are irradiated with soft X-rays having a wavelength of 1 Å to several hundred Å for removing static electricity therefrom, the soft X-rays being X-rays of a long-wavelength range (low energy range).

Regarding an X-ray generation method itself, static elimination apparatuses for irradiating soft X-rays for static elimination as described above basically use the same means as in the prior art.

Specifically, a typical generation method involves heating a filament as an electron emission source to several hundred ° C. or more in a vacuum atmosphere and applying a negative voltage to a circumference of the filament so that electrons are emitted. Due to the electron emission at a high temperature, the emitted electrons are generally called thermal electrons. The emitted thermal electrons are accelerated toward a positive potential side by an electric field and eventually collide with a vacuum tube constituent member (so-called target). Because an energy of the electrons is determined based on a difference of application voltage, when a potential of the filament as the electron emitting portion is −9 kV and a potential of the member with which the electrons collide is 0 V, for example, a kinetic energy of the emitted electrons is 9 keV.

X-rays are generated by using a material that is apt to emit braking X-rays or characteristic X-rays for the target with which the electrons emitted from the electron emitting portion collide. Generally, as the material for the X-ray target of this type, W, Ti, Cu, Mo, and the like are mainly used. Regarding a thickness of the target, though an optimal thickness is specified based on, in a case of a transmission type, a relationship between an electron ingression depth and a soft X-ray transmittance, a thickness of about 0.1 μm to 10 μm is generally used. On the other hand, in a case of a reflection type, the thickness only needs to be equal to or more than the electron ingression depth, and the X-rays generated from the target member whose thickness is not particularly limited are transmitted through a window constituted of a member that transmits X-rays relatively easily to thus be emitted to the outside.

For increasing an X-ray amount in an X-ray generation apparatus based on the generation principle as described above, it is necessary to increase an amount of electrons to be generated. For example, for increasing the X-ray amount by tenfold, the amount of electrons to be generated also needs to be increased by tenfold. In this case, for increasing the number of electrons by 10 folds without changing an applied voltage, it is necessary to either increase an electron generation surface area of the filament or additionally raise the filament temperature, but in either case, calorific value is largely increased. A large proportion of heat generation of the X-ray generation apparatus of the prior art occurs in such an electron generation portion, and heat generation caused by an electron current (=electron current×voltage) is no more than about 10 to 25% of the entire heat generation.

Reviewing the prior art while taking the above descriptions into consideration, an X-ray generation apparatus used in Patent Document 1 (Japanese Patent No. 2749202) uses a target member in which a thin target film formed of a material that emits X-rays after receiving electrons is formed on an X-ray transmissive substrate, the X-ray generation apparatus provided with a grid electrode between a filament and the target.

In Patent Document 2 (Japanese Patent Application Laid-open No. 2005-11635), a negative voltage with respect to a target is applied to a filament after the filament is energized and heated to several hundred ° C. or more, whereby thermal electrons are irradiated onto the target.

Similarly in Patent Document 3 (Japanese Patent Application Laid-open No. 2001-266780), thermal electrons are used as electrons with respect to an X-ray target.

Similarly in Patent Document 4 (Japanese Patent Application Laid-open No. Hei 7-211273), thermal electrons generated from a bar-type filament are used as electrons with respect to an X-ray target.

[Patent Document 1] Japanese Patent No. 2749202

[Patent Document 2] Japanese Patent Application Laid-open No. 2005-116354

[Patent Document 3] Japanese Patent Application Laid-open No. 2001-266780

[Patent Document 4] Japanese Patent Application Laid-open No. Hei 7-211273

DISCLOSURE OF THE INVENTION

Problems to be Solved by the Invention

The X-ray static elimination apparatus for static elimination, however, requires a low-energy (5 to 15 keV) radiation source that can emit a large amount of X-rays unlike X-ray generation apparatuses for other purposes, thus raising many problems. The problem regarding heat generation is most problematic.

In static elimination as a purpose of Japanese Patent No. 2749202, due to heat generation of an X-ray source, a proximal use is difficult in a process that requires precise temperature control, such as an exposure process in productions of a liquid crystal display and a semiconductor, since the process is adversely affected by heat. Therefore, it is necessary to secure a predetermined distance and install individual equipment for heat exhaustion processing such as heat exhaustion or water cooling so that a heat generation load does not become a source of the temperature raise of the atmosphere. Static elimination performance deteriorates inversely proportional to approximately a cube of the distance. Thus, inhibition of use at a close distance is extremely disadvantageous in terms of static elimination performance.

Moreover, because the cooling equipment involves plumbing of a ventilation duct or a chilled water pipe, the total cost increases up to twice or three times the cost of the static elimination apparatus main body. Further, improvement in the static elimination performance of the X-ray generation apparatus is limited from a restriction on heat resistance of an X-ray tube constituent member, and thus the static elimination performance may be insufficient for application depending on purposes. Especially in a film production process in which a conveyance speed is high, performance of the current X-ray generation apparatus is insufficient in actuality. This is because, as described above, an increase in the X-ray amount for an increase in an output leads to an increase in the amount of electrons to be generated, and the increase in the amount of electrons inevitably results in an increase in calorific value.

The cause of shortening lifetime of the X-ray static elimination apparatus is also mainly due to deterioration caused by heat generation. The lifetime of the X-ray static elimination apparatus of the prior art is about 10,000 hours, and a replacement needs to be made after about a year when used continuously. Thus, for additionally prolonging the lifetime, it is necessary to suppress deterioration of the emitter. Specifically, when a filament structure is used as the emitter, breaking of a wire that thins as the wire is used needs to be prevented. However, because of the use under a high-temperature condition in either case, significant improvement is difficult to be achieved at a current technical level. In particular, a high output and lifetime are in a tradeoff relationship, and it is thus impossible to improve both at the same time.

Meanwhile, although a bar- or plate-like X-ray generation is most structurally desirable for the X-ray static elimination apparatus, the X-ray generation apparatus that is based on the electron generation principle of the prior art is extremely unfit for such a structure. For producing a rectangular generation apparatus having a size of 5 cm W (width)×100 cm L (height)×2 cm D (depth), for example, a plurality of 100 cm-filaments are required, thus significantly increasing the calorific value and the heat generation area along therewith. As a result, the main body cannot but employ a water-cooling structure that uses a water-cooling mechanism, and thus an increase in the size cannot be avoided. For obtaining high static elimination performance, it is most important to install the static elimination apparatus in the vicinity of a place where static electricity is generated. Therefore, the increase in the size due to the water-cooling structure imposes a large restriction in terms of installment, whereby the structure cannot be applied in many cases. Furthermore, an increase in a total extension of the filament eventually leads to a significant reduction in the lifetime, the situation of which shows that the structure is practically inapplicable by the current technique.

Moreover, according to Japanese Patent Application Laid-open No. 2005-116354, a large proportion of the heat generation in the X-ray tube is occupied by heat generation in a filament portion, and a temperature of the generation tube itself easily increases to around 100° C. As described above, the lifetime is determined based on the breaking of a wire that is caused by the thinning of the filament itself, the lifetime normally being about 10,000 hours at maximum. Further, due to susceptibleness to vibration during light-up and the filament being apt to be broken by an impulsion, the lifetime is additionally shortened. Therefore, there is a problem that a usage at a place where vibration is apt to occur is not suitable.

In Japanese Patent Application Laid-open No. 2001-266780, the breaking of a wire does not occur since the thermal electron generation portion is not a filament structural body, and thus it can be expected that the lifetime can be prolonged as compared to that in Japanese Patent Application Laid-open No. 2005-116354. However, because, for obtaining a predetermined amount of thermal electrons, a temperature raise corresponding to that of the filament is required and a volume to be heated is larger than that of the filament, more calorific value is expected to be required, leading to an additional demerit caused by heat generation. At the same time, regarding an atmospheric vacuum level as an important condition for highly-efficient emission of the thermal electrons, the vacuum level can be predicted to decrease faster than that in Japanese Patent Application Laid-open No. 2005-116354, and thus the lifetime of the X-ray tube is considered to be shortened.

Also in the technique disclosed in Japanese Patent Application Laid-open No. Hei 7-211273, because a filament is used, total calorific value increases and the demerit caused by heat generation is worsened. As in Japanese Patent Application Laid-open No. 2001-266780, the same holds true for the decrease in the atmospheric vacuum degree.

The following is a summarization of problems unique to the X-ray generation apparatus for static elimination that is required of a large output and continuous lighting in the prior art described above.

(1) From the restriction on heat generation, there is a limit to an increase in the output of the X-ray amount.
(2) From the restriction on heat resistance, there is a limit to the constituent member that can be used for the X-ray generation tube.
(3) The increase in the output and the lifetime are in a tradeoff relationship.
(4) It is difficult to realize a surface light source and increase an area of the generation surface.

The present invention has been made in view of the above points, and it is therefore an object of the invention to provide a soft X-ray generation apparatus having heat generation of the electron emitting portion for generating electrons suppressed to thus solve the problems above, and a static elimination apparatus that uses the soft X-ray generation apparatus.

Means for solving the Problems

To attain the above object, a soft X-ray generation apparatus according to the present invention is characterized in that an electron emitting portion for generating soft X-rays has a surface constituted of a thin film formed of diamond particles each having a particle size of 2 nm to 100 nm, preferably 5 nm to 50 nm.

A diamond has NEA (Negative Electron Affinity), and the electron affinity being small, by constituting the surface of the electron emitting portion by the thin film formed of diamond particles each of a nanometer size, a potential barrier in the vicinity of the surface of the electron emitting portion is degraded, thus enabling emission of electrons at a lower voltage and lower electric field concentration. Because the emission is not the emission of thermal electrons that employs a filament as in the prior art, calorific value can significantly be suppressed and electrons can easily be emitted even at a low voltage. Therefore, an increase in the output, that is, an increase in the X-ray amount by emission of a large amount of electrons is facilitated. Moreover, due to the reduction in the heat generation, degassing has occurred more or less from the high-temperature filament and members in the vicinity thereof in the prior art, and X-ray generation characteristics have deteriorated due to adhesion of degassed gas with respect to the target surface. In this regard, in the present invention, because no heat is generated from the electron emitting portion, deterioration of the target due to degassing as in the prior art is suppressed. In addition, because the diamonds have a strong crystalline structure, the diamonds each have high hardness and are chemically stable. Accordingly, deterioration of the device hardly occurs, and thus the diamond is fit for the material of the electron emitting device in the soft X-ray generation apparatus.

Incidentally, when the diamond is used for the electron emitting device, basic electric conductivity is lowered as crystallinity of the diamond becomes higher, and it may thus be difficult to obtain a favorable electric contact with the conductive substrate as an electrode. Therefore, when a thin film formed of diamond particles each of a nanometer size is formed on the surface of the electron emitting portion, it is important to secure favorable adhesion between the diamond and the conductive substrate and uniformly disperse fine diamond particles. In addition, for obtaining high-output X-rays, the electron emitting portion needs to be constituted as the electron emitting device with a lower threshold electric field intensity.

In view of the above points, the inventors of the present invention have developed the following new thin film as the thin film to be formed on the surface of the electron emitting portion, the thin film formed of diamond particles each having a particle size of 2 nm to 100 nm, preferably 5 nm to 50 nm. It should be noted that the particle size of 2 nm to 100 nm is based on the result obtained by the inventors of the present invention using an X-ray analysis (calculation by Rietveld refinement) as used in FIG. 3 to be described later.

Specifically, the thin film has a diamond XRD pattern in an XRD measurement and, in a Raman spectroscopic measurement, a ratio of an sp3 bonding component to an sp2 bonding component within the film of 2.5 to 2.7:1. Accordingly, as will be described later, an electron emitting portion that satisfies the condition that the electric field intensity that provides 1 $mA/cm^2$ is 1 V/μm or less is realized.

According to the findings of the inventors of the present invention, in the case where the thus-structured diamond thin film is formed on the surface of the electron emitting portion, when a used air atmospheric temperature is 25° C., while the temperature raise of the electron emitting portion in the prior art is normally 600° C. or more (temperature difference of 575° C. or more with respect to the ambient temperature), the soft X-ray generation apparatus of the present invention can suppress the temperature raise to 80° C. or less (temperature difference of 55° C. or less with respect to the ambient temperature), and moreover, can obtain a larger number of electrons to be generated than the prior art.

Furthermore, by causing a carbon nano wall (CNW) and the diamond film to grow continuously on the conductive substrate, an electron emitting device with an additionally lower threshold electric field intensity can be obtained. Moreover, such a two-stage structure results in an improvement in electron emission characteristics due to enhancement of the electric field concentration. In addition, by interposing the carbon nano wall having excellent plasticity between the diamond thin film and the conductive substrate, there can be obtained an effect of not only widening the selection range of the substrate material, but also suppressing peeling of the diamond film by a thermal shock that is caused in the cooling process after deposition of the diamond thin film. It should be noted that a thickness of the carbon nano wall is preferably 5 μm or less, and the carbon nano wall may be in a form of a film or may be in a scattered nucleus form.

When embodying as the soft X-ray generation apparatus, it is preferable that a potential difference between the applied voltage of the electron emitting portion and the target be 5 to 15 kV and the temperature raise of the electron emitting portion be 50° C. or less with respect to the ambient temperature.

Further, an X-ray emission portion from which soft X-rays are emitted preferably has a potential ranging from −100 V to +100 V.

The electron emitting portion and the target may constitute a parallel plate structure, for example.

Further, a static elimination apparatus according to the present invention is characterized by including the soft X-ray generation apparatus described above, and in that an energy range of the soft X-rays emitted from the static elimination apparatus is 5 keV to 15 keV.

The static elimination apparatus has a casing that is preferably constituted of a conductor having a volume resistivity of less than $10^9$ Ω·m, the casing having a structure with which electrostatic shielding is possible.

An emission window from which the soft X-rays are emitted preferably has a transmittance of generated soft X-rays of 5% or more.

The emission window is formed of at least one kind of material selected from the group consisting of Be, glass, and Al.

EFFECT OF THE INVENTION

According to the present invention, because calorific value accompanying the generation of electrons can significantly be reduced, when used as the static elimination apparatus, for example, an increase in the output can easily be obtained and fluctuating of ambient temperature can be avoided. Further, because it is unnecessary to provide heat resistance to the constituent member in the periphery of the electron emitting portion and because a large amount of electrons can easily be generated, it is possible to even use a window material having somewhat low X-ray transmittance performance for the emission window. Thus, it becomes possible to also use Al (including an Al alloy) and glass in addition to Be that is harmful and with which an increase of the area is difficult, thus improving a degree of freedom in design of the apparatus. In addition, due to less temperature raise, the decrease of the atmospheric vacuum degree can significantly be suppressed, leading to prolonging of a lifetime. Of course, since the filament is not used, the lifetime is not disrupted due to the breaking of a wire.

DESCRIPTION OF REFERENCE NUMERALS

Figure 1:
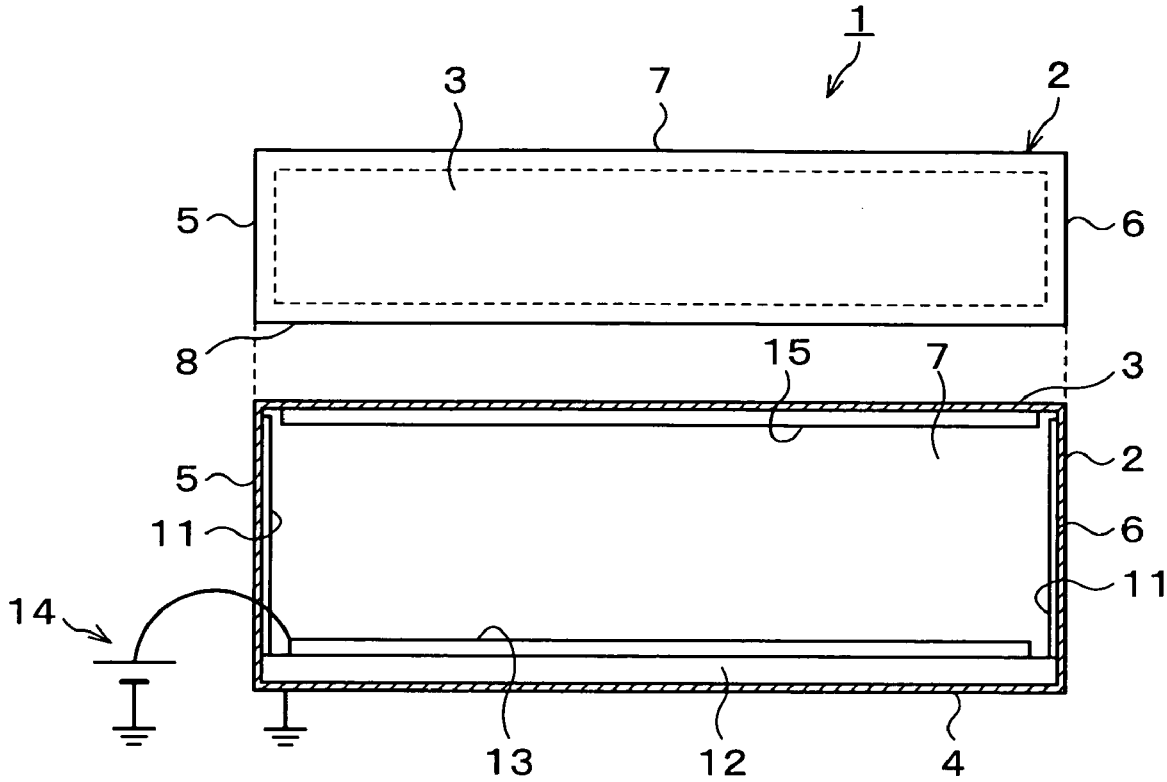
FIG. 1 is an explanatory diagram showing a plan view and cross-sectional side view of a static elimination apparatus according to a first embodiment.

1, 31, 41, 51 static elimination apparatus
2, 32, 42, 52 casing
13, 47, 61 emitter
14 DC power supply
15, 44 target
22, 64 thin film
63 carbon nano wall

BEST MODES FOR CARRYING OUT THE INVENTION

Next, descriptions will be given on preferable embodiments of the present invention. FIG. 1 shows a plan view and cross-sectional side view of a static elimination apparatus 1 according to a first embodiment. As can be seen from the figure, the static elimination apparatus 1 according to this embodiment is of a box shape as a whole.

A casing 2 as a vacuum vessel of the static elimination apparatus 1 is constituted by jointing, so as to be airtight, six panels each formed of Al (aluminum), that is, a top panel 3, a bottom panel 4, a left-hand-side panel 5, a right-hand-side panel 6, a front-side panel 7, and a back-side panel 8. The casing 2 itself is grounded. Insulators 11 are provided on an inner side of the left-hand-side panel 5, the right-hand-side panel 6, the front-side panel 7, and the back-side panel 8, respectively. Further, an insulation panel 12 is disposed on an upper surface of the bottom panel 4, and an emitter 13 as an electron emitting portion is disposed on an upper surface of the insulation panel 12. The emitter 13 is applied with a predetermined DC voltage from a DC power supply 14 provided outside the static elimination apparatus 1.

A target 15 is provided on a back surface (inner-side surface) of the top panel 3. This embodiment uses a tungsten thin film having a thickness of 1 μm. It should be noted that a material for the target 15 is not particularly limited to tungsten and only needs to be a material that emits braking X-rays or characteristic X-rays with an energy of 5 to 15 keV. For example, titanium can be used instead. The emitter 13 and the target 15 are positioned in parallel, thus constituting a parallel plate structure. Further, both the emitter 13 and the target 15 have a rectangular shape of a 3 cm×15 cm size. The top panel 3 formed of Al constitutes an X-ray emission window. The emission window is preferably formed of a material that has high transmission performance with respect to soft X-rays, and preferably has a sufficient mechanical strength as a constituent member of the vacuum vessel. Furthermore, as for a substrate on which a target material is deposited (normally, the substrate also functions as the emission window), it is preferable that, in addition to the transmittance performance of soft X-rays, heat transfer performance is high.

Figure 2:
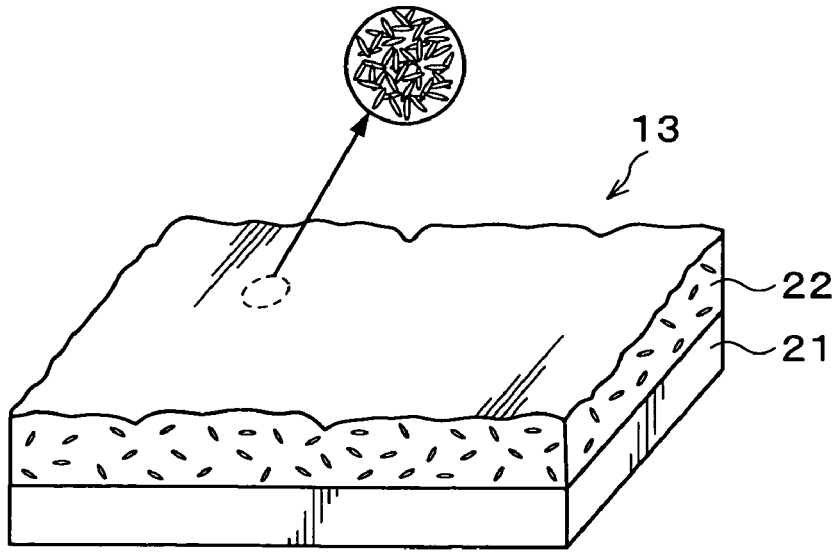
FIG. 2 is an explanatory diagram showing a structure of an emitter used in the static elimination apparatus according to the first embodiment.

Next, a structure of the emitter 13 will be described in detail. The emitter 13 used in this embodiment has a structure shown in FIG. 2. Specifically, a thin film 22 as a polycrystal film, in which diamond particles each of a nanometer size like 5 nm to 50 nm are aggregated, is formed on a conductive substrate 21. A thickness of the thin film 22 is 1 to 10 μm, preferably 1 to 3 μm.

The thin film 22 is formed as follows. First, a low-resistance silicon single crystal plate having Ra (average roughness of center line) of 3 μm or less is used as the conductive substrate 21. Moreover, a DC plasma CVD apparatus is used to carry out deposition processing on the conductive substrate 21.

Specifically, a silicon single crystal wafer (100) is first cut out in a 30 mm×30 mm square shape, and a scratch process is carried out on a surface thereof using diamond particles each having a size of 1 to 5 μm, for example. After that, delipidation and washing of the substrate surface is carried out sufficiently. Accordingly, Ra of the surface of the conductive substrate 21 is made to be 3 μm or less.

Subsequently, the deposition processing is carried out by causing 50 SCCM of methane gas and 500 SCCM of hydrogen gas to flow, maintaining a pressure within the processing vessel of the CVD apparatus at 7998 Pa (60 Torr), rotating the conductive substrate 21 at 10 rpm, and adjusting a heater for heating the substrate such that a variation of the substrate temperature becomes 5° C. or less. At an initial stage of the deposition, the substrate temperature is maintained at 750° C. for 30 minutes, and a voltage of the heater is then increased to raise the substrate temperature to 840° C. to 890° C., preferably 860° C. to 870° C. After that, the deposition processing is carried out for 120 minutes.

Figure 3:
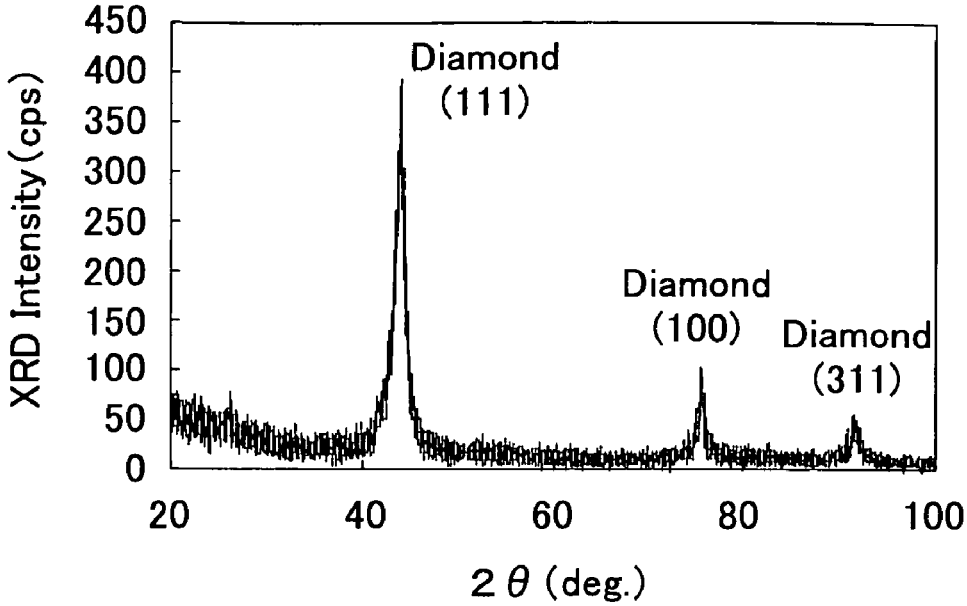
FIG. 3 is an diagram of XRD of a thin film of the emitter shown in FIG. 2.

When observed with a scan-type electronic microscope, the surface of the thin film 22 deposited as described above has, as shown in the circle of FIG. 2, a "bamboo leaves" structure in which about several ten to several hundred fine diamond particles are aggregated. In addition, the surface of the film is flat with no distortion. It has been confirmed that the thin film itself has a simple constitution and also by a pattern diffraction of XRD shown in FIG. 3 that the thin film 22 is a uniform diamond film starting from an interface of the conductive substrate 21 to the surface of the thin film 22. It should be noted that FIG. 3 is based on a parallel beam method, and $\alpha=1°$. It should be noted that no graphite peak was observed in the thin film 22.

Described next are specific characteristics thereof.

Figure 4:
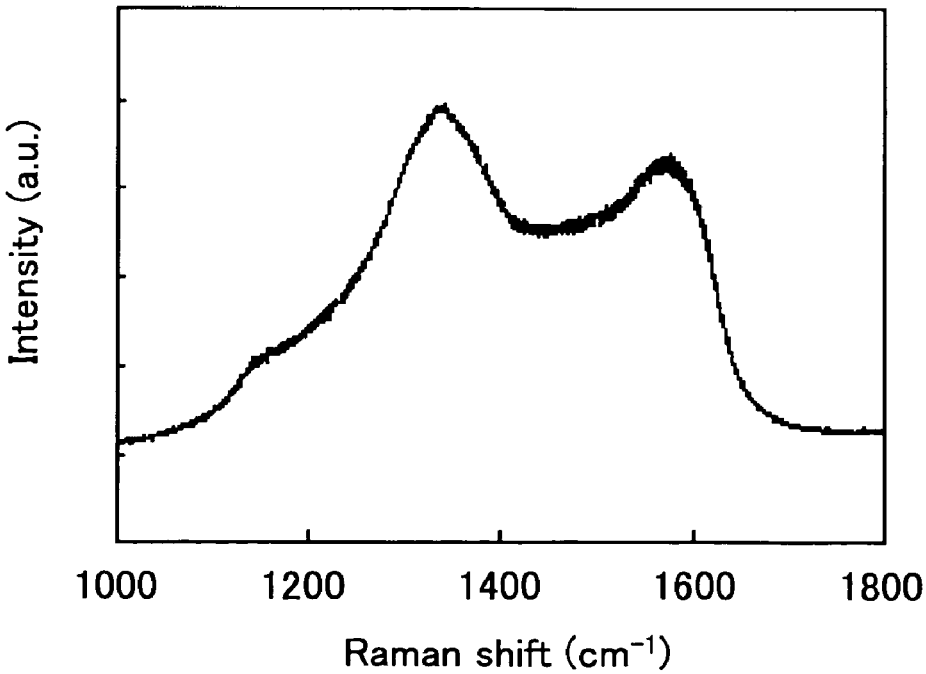
FIG. 4 is a graph showing a Raman spectrum of the thin film of the emitter shown in FIG. 2.

(1) The surface shows that about several ten to several hundred fine particles each having a size of 5 nm to 50 nm are aggregated to thus form like a single "bamboo leaves" structure.
(2) Needle-like protrusions each having, regarding a part thereof that protrudes from the flat surface of the thin film 22, a height of 3 μm or more and 10 μm or less and a thickness of about 10 to 100 nm are present at a density of 10,000 protrusions/$mm^2$ to 100,000 protrusions/$mm^2$.
(3) Regarding the surface roughness of a part with no needle-like protrusions, Ra is 500 nm or less when a structure of a lower portion of the thin film is not reflected.
(4) According to a Raman spectroscopic measurement using a laser having a wavelength of 532 nm, a half-value width of a peak of a diamond at 1333 $cm^{-1}$ is 500 $cm^{-1}$ or more, and, as shown in FIG. 4, there are two peaks, that is, a peak having an apex in the vicinity of 1360 $cm^{-1}$ and a peak having an apex in the vicinity of 1581 $cm^{-1}$.

Figure 5:
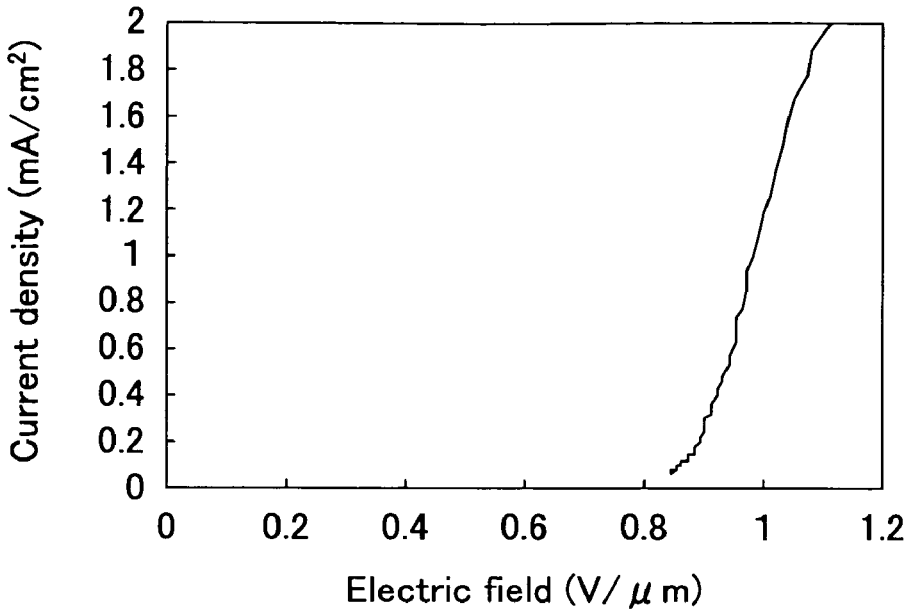
FIG. 5 is a graph showing electron emission characteristics of the thin film of the emitter shown in FIG. 2.

Observation of I-V characteristics of the thin film 22 showed the result as shown in FIG. 5. According to FIG. 5, the threshold electric field intensity is 0.95 V/μm. It should be noted that upon observing a light emission state of a fluorescent plate by the emission of electrons from the emitter 13 on the surface of which the thin film 22 is formed, a uniform light emission state with no light emission spot was observed.

Figure 6:
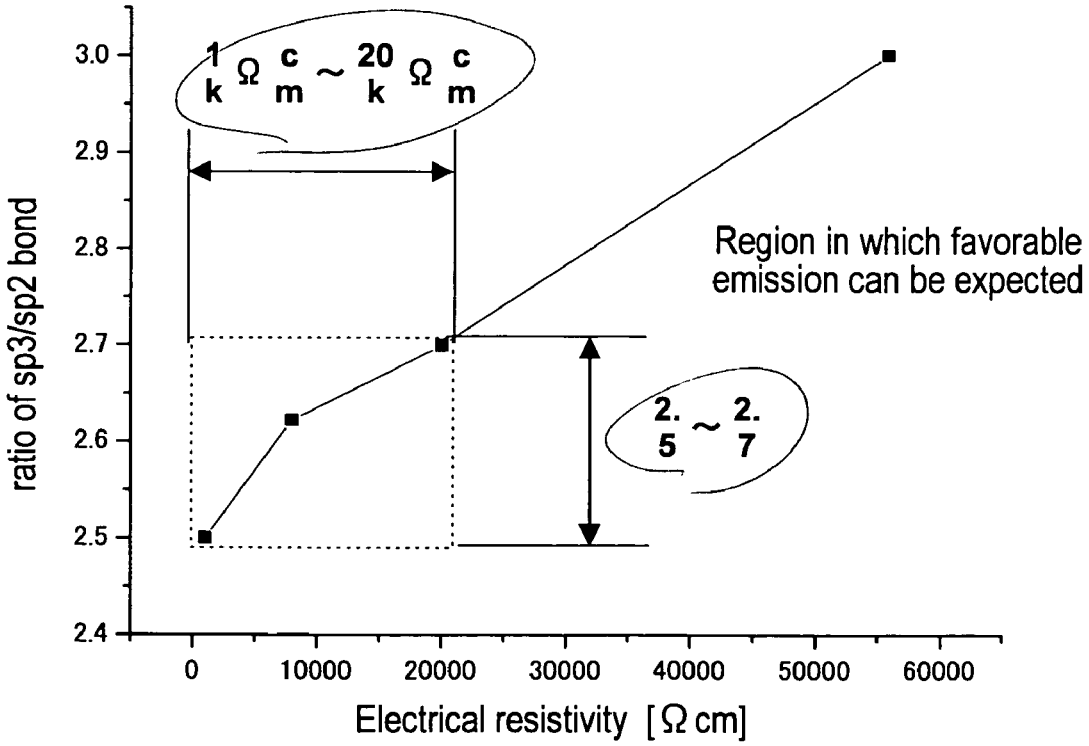
FIG. 6 is a graph showing changes in a ratio of an sp3 bonding component to an sp2 bonding component in the thin film of the emitter shown in FIG. 2 and electrical resistivity of the thin film.

Moreover, a further observation by the inventors of the present invention showed that a ratio of an sp3 bond derived from a diamond component to an sp2 bond derived from a graphite component within the thin film 22 was 2.5. The relationship thereof with the electrical resistivity, while making a suitable change within the range of the deposition temperature described above and changing the ratio of the sp3 bonding component to the sp2 bonding component, was as shown in FIG. 6. The ratio of the sp3 bonding component to the sp2 bonding component was evaluated by a Raman light emission method. Though the ratio of the sp3 bonding component to the sp2 bonding component is also affected by a plasma density, a film composition can indirectly be predicted such that, by calculating an emissivity by dispersion during the deposition process, the emissivity of 0.7 is sp3 (diamond) and the emissivity that is close to 1 is sp2 (graphite). Moreover, it has been found that when the ratio of the sp3 bonding component to the sp2 bonding component is within the range of 2.5 to 2.7, the electrical resistivity of 1 kΩcm to 20 kΩcm at which favorable emission can be expected can be obtained.

According to the static elimination apparatus 1 according to this embodiment in which the thin film 22 having the above characteristics is formed on the surface of the emitter 13, by applying a DC voltage to the emitter 13, soft X-rays are irradiated from the emission window (top panel 3) at a wide angle close to 180 degrees. When a DC voltage of −9.5 kV is applied to the emitter 13, an electron irradiation amount (electron current conversion) becomes 5 mA and reached about 30 times as large as that of the filament type of the prior art. In this embodiment, because Al having lower transmittance performance than Be generally used in the prior art is used as the material for the emission window (top panel 3), although the transmittance is resultantly about ⅕ compared to Be, the X-ray amount of the soft X-rays that can eventually be obtained became 6 times (30×⅕) as large as that of the filament-Be emission window type of the prior art.

In addition, temperature raise of the emitter 13 was hardly observed, which was of a level of several ° C. Although heat is certainly generated by the electron current (5 mA×9 kV=45 W), because Al having a high thermal conductivity is used as the material for the emission window (top panel 3) and the casing 2, temperature raise of the apparatus itself is relatively low. In this regard, when the filament-type soft X-ray static elimination apparatus of the prior art is operated for obtaining an X-ray irradiation amount the same as that of the static elimination apparatus according to this embodiment, the total calorific value is predicted to be about 300 W, with the fear of a short lifetime due to the temperature raise and an effect of heat on the static elimination object. However, as described above, according to the static elimination apparatus 1 of this embodiment, because the temperature raise is small, the lifetime is prolonged significantly, with less effect on the static elimination object and the ambient temperature.

It should be noted that in this embodiment, although Al having lower transmittance than Be is used as the material for the emission window, because Al has a higher mechanical strength than Be, the thickness can be made smaller than that in the case of using Be. Further, due to the high mechanical strength, handling is made easier than the apparatus that uses Be as the window material, and formation of an emission window that is larger than that in the case of using Be is facilitated.

Of course, Be may be used as the material for the emission window. In this case, it is possible to provide a higher transmittance to the emission window formed of Be by adding an appropriate reinforcement material every 2 cm in the longitudinal direction, for example. In this case, because the electron generation amount can be reduced to as small as ⅕ for obtaining the same X-ray amount, there is a merit that the total calorific value can significantly be reduced to 9 W (45/5).

It should be noted that according to the findings of the inventors of the present invention, when producing the emitter as the electron emitting portion to be used in the present invention, it is desirable that the substrate has, on the surface thereof, center line average roughness of 3 μm or less, and regarding the gas to be used as the deposition gas, a ratio of a methane concentration to a concentration of other gas is 8% or more. Moreover, it is desirable to carry out the deposition processing while controlling, in the last 0.5 hour or more of the deposition, the substrate temperature within the range of −20° C. to +20° C. from the temperature at which graphite starts to be deposited on a part of the substrate surface.

The static elimination apparatus 1 according to the first embodiment described above is of a box shape as a whole. However, the static elimination apparatus according to the present invention can be embodied as an apparatus having other shapes. A static elimination apparatus 31 according to a second embodiment shown in FIG. 7 has an apparatus structure fit for elimination of static electricity that is generated when wide films, glass substrates, or the like are conveyed continuously, and is structured like a bar as a whole. Therefore, an emission window (top panel 3) having a size of 0.5 cm×100 cm is used. As for a casing 32 itself, an Al alloy is employed as in the static elimination apparatus 1 according to the first embodiment. It should be noted that members having the same functions as those of the static elimination apparatus 1 according to the first embodiment are denoted by the same reference numerals. In the static elimination apparatus 31 according to the second embodiment, Ti is used as the material for the target 15, and the applied voltage is −10 kV. It goes without saying that as in the static elimination apparatus 1 according to the first embodiment, in the static elimination apparatus 31 according to the second embodiment, the material of the emission window (top panel 3) alone can easily be changed to Be by adding an appropriate reinforcement material every several cm.

Figure 8:
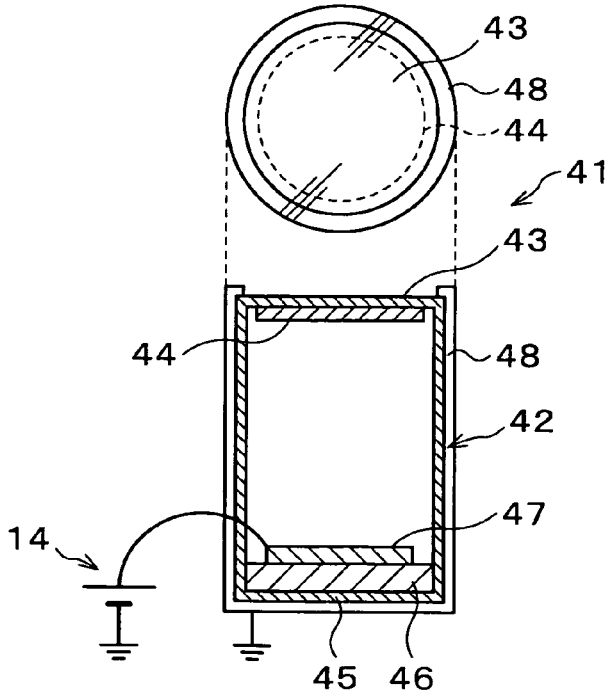
FIG. 8 is an explanatory diagram showing a plan view and cross-sectional side view of a static elimination apparatus according to a third embodiment.

FIG. 8 shows a plan view and cross-sectional side view of a static elimination apparatus 41 according to a third embodiment. The static elimination apparatus 41 according to the third embodiment is a cylindrical X-ray static elimination apparatus made of glass. In other words, a casing 42 itself of the static elimination apparatus 41 is constituted entirely of a cylindrical glass as an insulator. In addition, a target 44 is provided on a back surface of a top panel 43 as an emission window having a diameter of 2 cm. In this embodiment, a tungsten film having a thickness of 1 μm is employed as the target 44. Further, a disk-like emitter 47 is disposed on an upper surface of a bottom panel 45 via an insulator 46, and the emitter 47 is connected to the DC power supply 14. A structure of the emitter 47 is the same as that of the emitter 13 according to the first embodiment described above, and a diamond thin film having the same structure as the thin film 22 is formed on a surface thereof.

Because the casing 42 of the static elimination apparatus 41 is constituted entirely of glass as an insulation material as described above, the surface of the casing 42 except the top panel 43, that is, an outer circumference and an outer side of the bottom panel 45, is covered by a cylindrical case 48 formed of an Al alloy. The case 48 is grounded.

In the static elimination apparatus 41 according to the third embodiment, when a DC voltage is applied to the emitter 47 with the applied voltage of −12 kV, the electron irradiation amount is 2 mA and the total calorific value is about 24 W. The obtained X-ray amount is, regardless of the fact that Al that has ⅕ the X-ray transmission performance as Be is used for the emission window (top panel) 43, twice as that of the apparatus of the filament-Be emission window type of the prior art.

Figure 9:
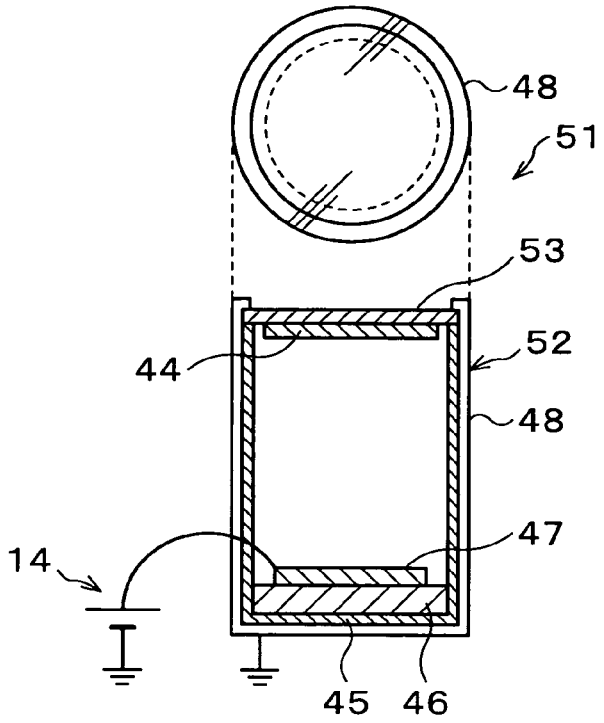
FIG. 9 is an explanatory diagram showing a plan view and cross-sectional side view of a static elimination apparatus according to a fourth embodiment.

FIG. 9 shows a plan view and cross-sectional side view of a static elimination apparatus 51 according to a fourth embodiment. A casing 52 of the static elimination apparatus 51 has the same cylindrical shape formed of glass as the casing 42 except for the top panel 43 of the static elimination apparatus 41 according to the third embodiment. In the static elimination apparatus 51 according to the fourth embodiment, Be is used as a material for a top panel 53.

According to the static elimination apparatus 51 of the fourth embodiment, because Be is used for the top panel as the emission window, the X-ray amount becomes 10 times as large as that of the prior art. The calorific value is 24 W which is the same as that of the static elimination apparatus 41 according to the third embodiment. Therefore, it can be seen that, because the calorific value is equivalent to that of the apparatus of the prior art having 1/10 the X-ray amount, the calorific value corresponding to the same X-ray amount is reduced to 1/10 the X-ray amount of the apparatus of the filament-Be emission window type of the prior art.

Figure 10:
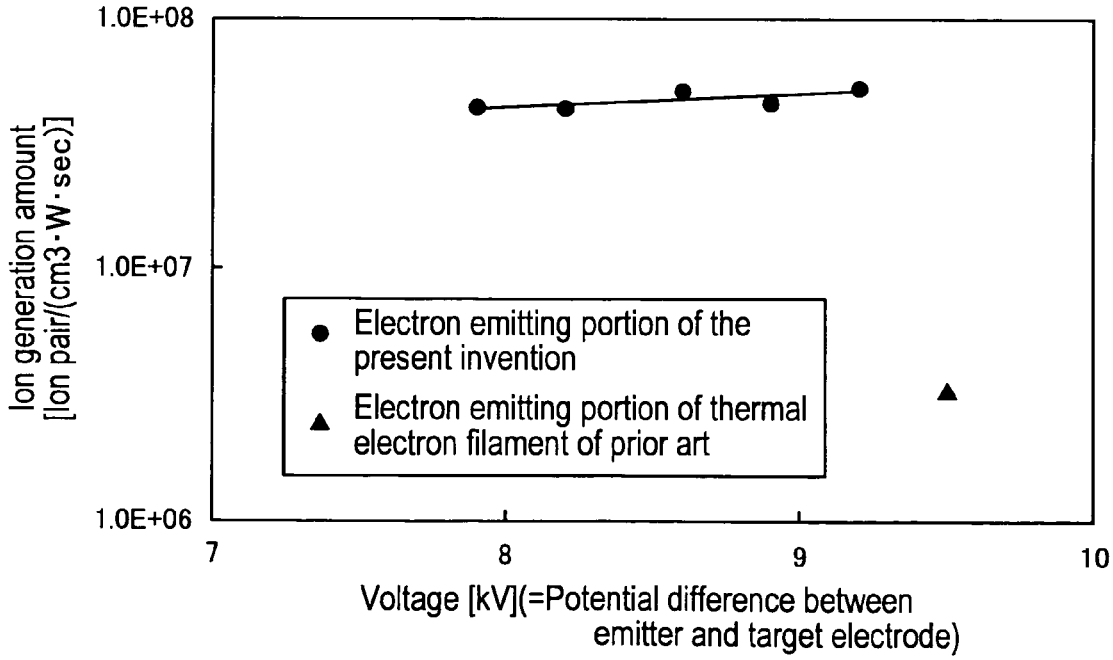
FIG. 10 is a graph showing relationships between an applied voltage and an ion generation amount in the static elimination apparatus shown in FIG. 9 and a thermal-electron-emission-type static elimination apparatus of the prior art, respectively.

Next, evaluations of static elimination performance at the same irradiation distances are performed with respect to the case where, in the static elimination apparatus 51, a Be plate of 0.6 mm is used for the top panel 53 as the emission window, Mo is used for the target 44, and an emitter of about 0.25 $cm^2$ the surface of which has a thin film formed of diamond particles each having a nanometer size is used as the emitter 47, and the case where, in the static elimination apparatus of the prior art type, a filament for emitting thermal electrons is used for the emitter, an exemplary result of which is shown in the graph of FIG. 10.

In the graph, the abscissa axis represents a potential difference (DC applied voltage) between the emitter and the target, and the ordinate axis represents an air ion (positive and negative ions) generation amount as an index of the static elimination performance per unit power consumption. The static elimination performance is in a proportional relationship with the ion pair generation amount, so if the ion generation amount is doubled, the static elimination performance is also doubled. The ion generation amount of the static elimination apparatus 51 of the above specification tends to slightly increase as the applied voltage increases, and it can be seen that in any applied voltage range, the generation amount that is 10 times or more the ion generation amount of the static elimination apparatus of the prior art type that uses a filament for emitting thermal electrons as the emitter is obtained.

It should be noted that a current density of the emitter of the static elimination apparatus 51 of the above specification is of a level of 4 to 6 $mA/cm^2$, which is an optimal range. Further, the distance between the emitter and the target is 10 mm or less, thus obtaining an extremely compact static elimination apparatus. Describing the static elimination apparatus as a whole, the power consumption of the static elimination apparatus 51 of the above specification that has 10 times the static elimination performance as the static elimination apparatus of the prior art type used for the comparison is 5 to 6 W, whereas that of the static elimination apparatus of the prior art type is 6 to 8 W. Thus, only 1/10 or less of the power consumption is required with respect to the same ion generation amount, which is extremely efficient. It should be noted that in this comparison, a loss in a power supply system of the static elimination apparatus of this embodiment is excluded, so the actual difference is predicted to be about a few percentage.

Figure 7:
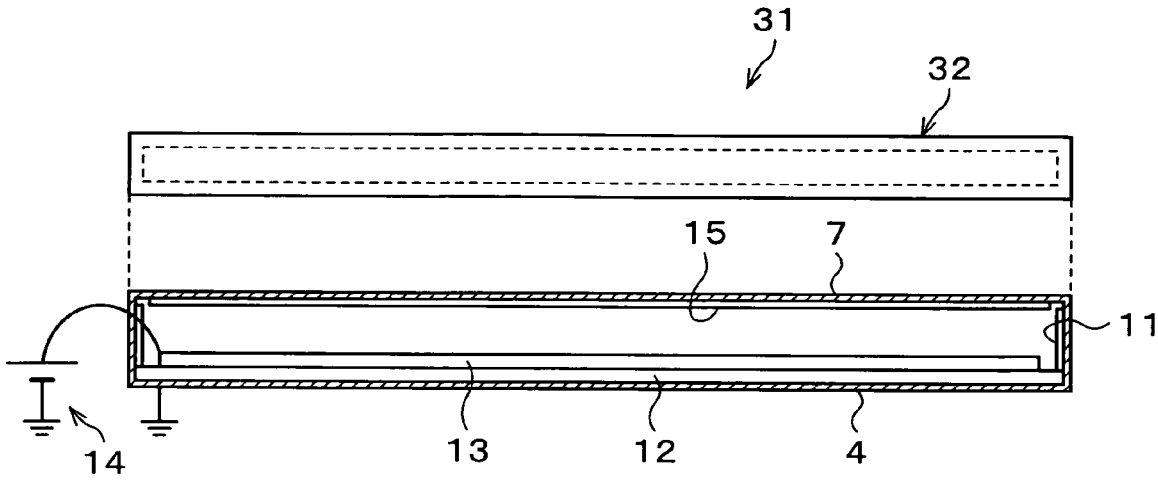
FIG. 7 is an explanatory diagram showing a plan view and cross-sectional side view of a static elimination apparatus according to a second embodiment.

It should be noted that although the data shown in FIG. 10 is comparison data of the ion generation amount in the static elimination apparatus having substantially the same structure as that of the prior art type, a significant increase of the ion generation amount can also be expected in the static elimination apparatuses having the structures respectively shown in FIGS. 1, 7, and 8.

An emitter having a diamond thin film formed on the conductive substrate is used as the emitters 13 and 47 used in the above embodiments. However, an emitter having a carbon nano wall interposed between the conductive substrate and the thin film may also be used.

Figure 11:
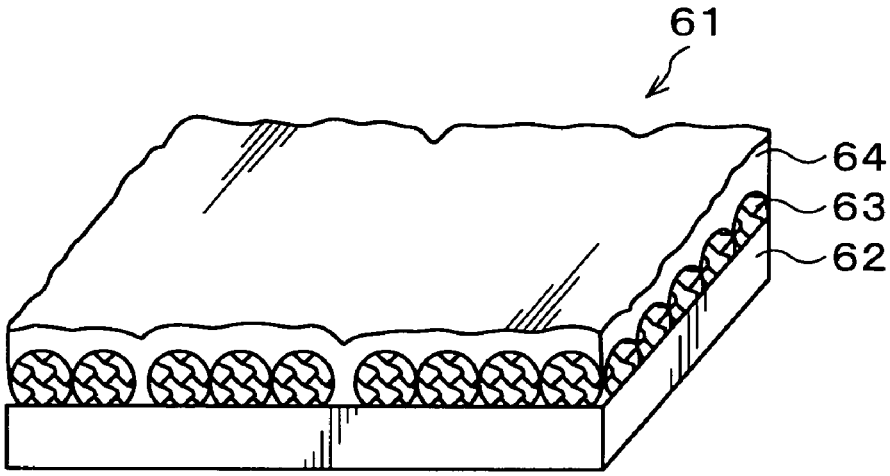
FIG. 11 is an explanatory diagram showing a structure of an emitter that includes a carbon nano wall.

FIG. 11 shows a structure of an emitter 61 that has a carbon nano wall interposed therein. The emitter 61 has a structure in which an intermediate layer 63 constituted of a carbon nano wall is formed on a nickel substrate 62, and a thin film 64 formed of diamond particles each having a particle size of 2 nm to 100 nm, preferably 5 nm to 50 nm is formed on the intermediate layer 63.

The emitter 61 having the above structure can be obtained by the following process, for example. First, using a DC plasma CVD apparatus, nucleuses of a carbon nano wall are formed on the nickel substrate 62, and the nucleuses are grown so that a carbon nano wall having petal-shaped carbon flakes is formed. Prior to the formation, similar to the case of forming the thin film described above, delipidation and washing of a surface of the nickel substrate 62 are carried out sufficiently.

A reaction gas is a mixture gas of a carbon-containing compound gas and hydrogen. As the carbon-containing compound, a hydrocarbon compound such as methane, ethane, and acethylene, an oxygen-containing hydrocarbon compound such as methanol and ethanol, aromatic hydrocarbon such as benzene and toluene, carbon dioxide, and mixtures thereof can be used. By appropriately selecting conditions of a mix ratio, gas pressure, substrate bias voltage, and the like of the reaction gas, it is possible to form nucleuses of the carbon nano wall in the vicinity of scratches on the nickel substrate 62 within the substrate temperature range of 700° C. to 1000° C.

For example, the deposition is carried out by causing methane to flow by a flow rate of 50 SCCM and hydrogen by 500 SCCM, maintaining a pressure within the processing vessel of the CVD apparatus at 7998 Pa (60 Torr), rotating the nickel substrate 62 at 10 rpm, and adjusting a heater for heating the substrate such that a variation of the substrate temperature becomes 5° C. or less. Then, with the substrate temperature during the deposition set to be within 900° C. to 1100° C., preferably 890° C. to 950° C., the deposition processing is carried out for a deposition time of 120 minutes. Accordingly, nucleuses of the carbon nano wall are first generated on the nickel substrate 62, and the nucleuses are grown so as to form a carbon nano wall having petal-shaped carbon flakes, whereby the intermediate layer 63 constituted of the carbon nano wall can be formed on the nickel substrate 62. In addition, due to an additional growth, the thin film 64 can be formed continuously on the intermediate layer 63.

Although the carbon nano wall has excellent electron emission characteristics, presence of unevenness of several microns makes it difficult to form a uniform emission site. Therefore, it is possible to obtain a uniform surface configuration by depositing a thin film constituted of fine diamond particles on the carbon nano wall. A thickness of the carbon nano wall in this case is desirably within a range of a thickness in a state where only the nucleuses that have failed to form a film are present to 5 μm. With this as the intermediate layer, a thickness of the nano diamond film formed thereon is 0.5 μm to 5 μm, preferably a minimum thickness necessary for entirely covering the carbon nano wall nucleuses and the carbon nano wall film. In other words, it is desirable to deposit the diamond film until an enveloping surface of a petal-shaped graphenesheet aggregate of the carbon nano wall is formed into a membrane without any defect.

For the nano diamond film to smooth the unevenness of the carbon nano wall, the electron emission from the emitter is planarized. Further, although an electric field concentration weakens due to the planarization of the structure, because a work function decreases equally or more than that effect, it is possible to make the threshold electric field intensity 0.9 V/μm or less.

Further, the carbon nano wall can be deposited on various materials relatively easily as compared to diamond. Therefore, regarding the emitter having a structure in which the carbon nano wall is generated as the intermediate layer for depositing fine diamond particles onto the metal substrate, and the fine diamond particles are deposited on the carbon nano wall, the selection range of the material for the conductive substrate is widened and the degree of freedom in design is thus enhanced.

Figure 12:
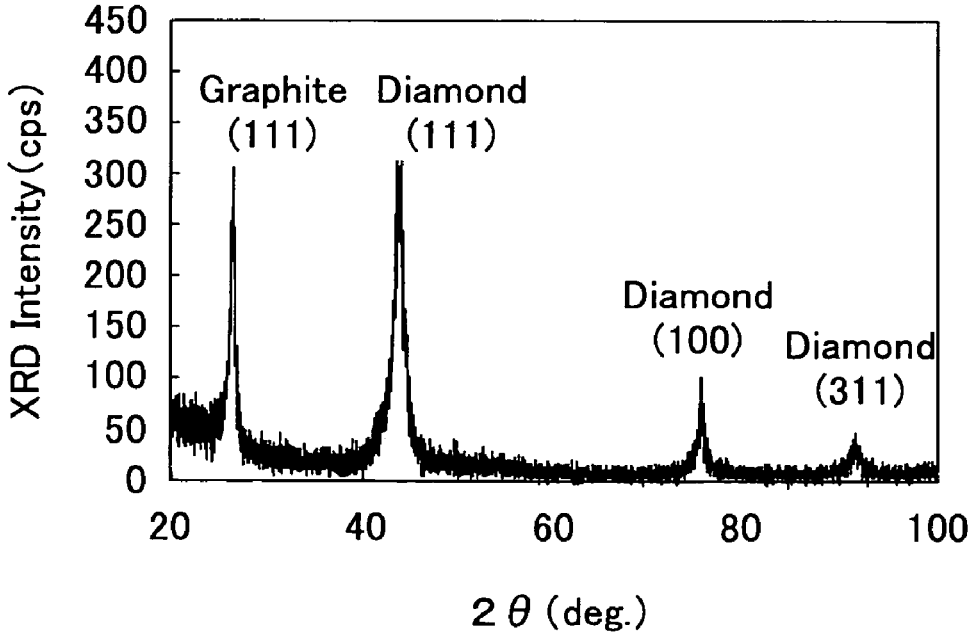
FIG. 12 is a diagram of XRD of an emitter film of the emitter shown in FIG. 11.
Figure 13:
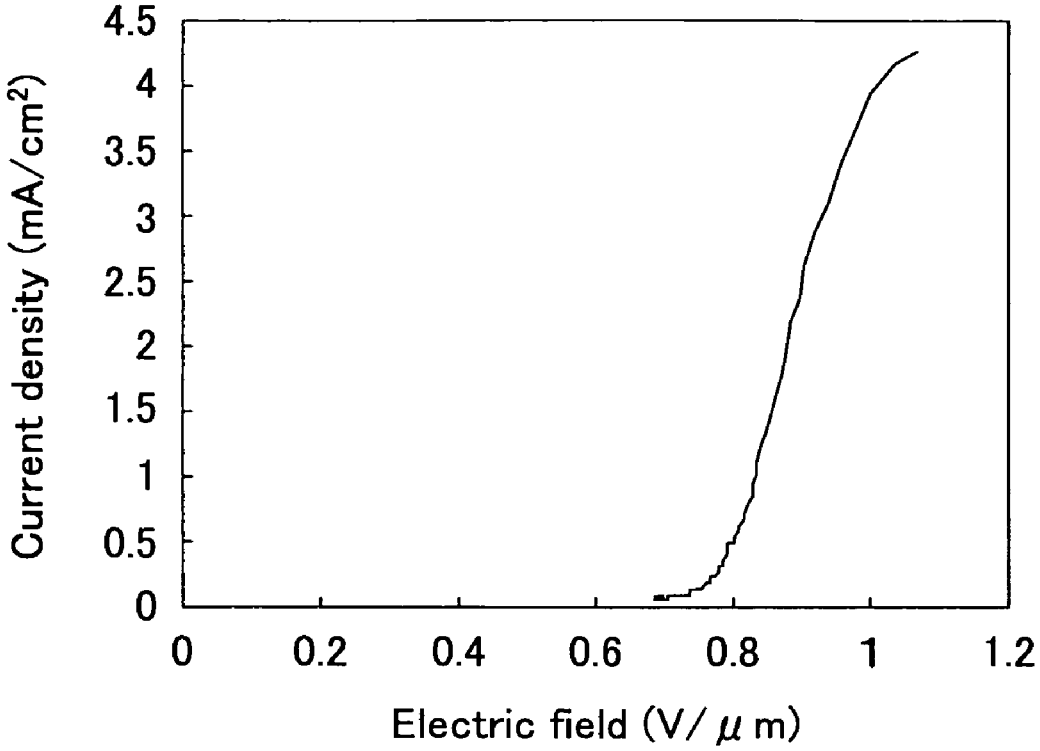
FIG. 13 is a graph showing electron emission characteristics of the thin film of the emitter shown in FIG. 11.

An X-ray diffraction diagram of an emitter film of the emitter 61 having the structure shown in FIG. 11 is shown in FIG. 12. As compared to the emitter 13 described above, a graphite (CNW) peak can be observed. Observation of the I-V characteristics of the emitter 61 showed the result as shown in FIG. 13. According to FIG. 13, the threshold electric field intensity is 0.84 V/μm. Specifically, according to the emitter 61 having the intermediate layer constituted of the carbon nano wall, the threshold electric field intensity is additionally decreased as compared to the emitter 13 described above that does not include the intermediate layer constituted of the carbon nano wall. Therefore, the electron emission characteristics are additionally improved due to the enhancement of the electric field concentration. Further, there is a merit that no catalyst is required in the production and the selection range of the conductive substrate is widened.

As described above, in the thermal-electron-type soft X-ray generation apparatus of the prior art, the electron emission amount depends on the emitter temperature, the emitter surface area, and the electric field intensity applied to the emitter surface. However, because of the reduction in the surface area due to thinning of the emitter along with the use thereof and the change in the surface temperature, the electron emission amount is apt to change. As a countermeasure, a grid electrode is generally disposed between the emitter and the target, and control is performed by applying a voltage to the grid electrode so that the electron current becomes constant.

On the other hand, in the soft X-ray generation apparatus and the static elimination apparatus according to the present invention, because the generated electron current depends only on the emitter area and the electric field intensity in the vicinity of the emitter surface, the electron current as designed can stably be obtained permanently without any temporal change, the characteristic being that a compact and inexpensive soft X-ray generation apparatus having a simple structure without a grid electrode can be obtained. Because there is no demerit in terms of performance even if the grid electrode is provided, there is, of course, no problem even in the case of a three-electrode structure (emitter, grid, and target electrodes) as in the prior art.

The device to which the nano diamond electron emitting device is applied is required to be smoothened by applying the three-electrode structure or the like when used as a light emitting device of visible light due to electron generation spots of a submillimeter order. When applied to the static elimination apparatus using a soft X-ray generation tube, however, the X-rays from the soft X-ray generation source spread widely, and spots are hardly generated in the irradiated X-rays. Further, because static elimination is carried out by ionizing the atmosphere around the objected to be neutralized by the soft X-rays, no functional problem is caused even when variations (spots) of X-rays are caused within the movement range of the generated ions. Thus, the static elimination apparatus is optimal as an application apparatus that uses the nano diamond emitter.

INDUSTRIAL APPLICABILITY

The present invention is particularly useful in, in a production process of various electronic components such as a semiconductor device, an FPD glass substrate, and other products that are produced in an environment under severe temperature conditions in particular, removing static electricity of those components and products.

The invention claimed is:

1. A soft X-ray generation apparatus, comprising:
an electron emitting portion; and
a target,
wherein a surface of the electron emitting portion comprises a thin film formed of diamond particles, each having a particle size of 2 nm to 100 nm, and
wherein the thin film has a diamond XRD pattern in an XRD measurement and, in a Raman spectroscopic measurement, a ratio of an sp3 bonding component to an sp2 bonding component within the film of 2.5 to 2.7:1.

2. The soft X-ray generation apparatus as set forth in claim 1,
wherein a potential difference between an applied voltage of the electron emitting portion and the target is 5 kV to 15 kV, and
wherein a temperature increase of the electron emitting portion is 50° C. or less with respect to an ambient temperature.

3. The soft X-ray generation apparatus as set forth in claim 1, wherein an X-ray emission portion from which soft X-rays are emitted has a potential ranging from −100 V to +100 V.

4. The soft X-ray generation apparatus as set forth in claim 1, wherein the electron emitting portion and the target form a parallel plate structure.

5. A static elimination apparatus that irradiates soft X-rays on an object or in a vicinity of the object to remove static electricity of the object, comprising a soft X-ray generation apparatus including an electron emitting portion and a target,
wherein a surface of the electron emitting portion comprises a thin film formed of diamond particles, each having a particle size of 2 nm to 100 nm,
wherein the thin film has a diamond XRD pattern in an XRD measurement and, in a Raman spectroscopic measurement, a ratio of an sp3 bonding component to an sp2 bonding component within the film of 2.5 to 2.7:1, and
wherein an energy range of the soft X-rays emitted from the static elimination apparatus is 5 keV to 15 keV.

6. The static elimination apparatus as set forth in claim 5, wherein the static elimination apparatus has a casing comprising a conductor having a volume resistivity of less than $10^9$ Ω·m, the casing having a structure with which electrostatic shielding is possible.

7. The static elimination apparatus as set forth in claim 5, wherein an emission window from which the soft X-rays are emitted has a transmittance of generated soft X-rays of 5% or more.

8. The static elimination apparatus as set forth in claim 7, wherein the emission window is formed of at least one kind of material selected from the group consisting of Be, glass, and Al.

9. A soft X-ray generation apparatus, comprising:

an electron emitting portion; and a target, wherein a surface of the electron emitting portion comprises a thin film formed of diamond particles, each having a particle size of 2 nm to 100 nm, and wherein the electron emitting portion is provided with, between a conductive substrate thereof and the thin film, a carbon nano wall having a thickness of 5 μm or less.

10. The soft X-ray generation apparatus according to claim 9, wherein a potential difference between an applied voltage of the electron emitting portion and the target is 5 kV to 15 kV, and wherein a temperature increase of the electron emitting portion is 50° C. or less with respect to an ambient temperature.

11. The soft X-ray generation apparatus according to claim 9, wherein an X-ray emission portion from which soft X-rays are emitted has a potential ranging from −100 V to +100 V.

12. The soft X-ray generation apparatus according to claim 9, wherein the electron emitting portion and the target form a parallel plate structure.

13. A static elimination apparatus that irradiates soft X-rays on an object or in a vicinity of the object to remove static electricity of the object, comprising a soft X-ray generation apparatus including an electron emitting portion and a target, wherein a surface of the electron emitting portion comprises a thin film formed of diamond particles, each having a particle size of 2 nm to 100 nm, wherein the electron emitting portion is provided with, between a conductive substrate thereof and the thin film, a carbon nano wall having a thickness of 5 μm or less, and wherein an energy range of the soft X-rays emitted from the static elimination apparatus is 5 keV to 15 keV.

14. The static elimination apparatus according to claim 13, wherein the static elimination apparatus has a casing comprising a conductor having a volume resistivity of less than $10^9$ Ω·m, the casing having a structure with which electrostatic shielding is possible.

15. The static elimination apparatus according to claim 13, wherein an emission window from which the soft X-rays are emitted has a transmittance of generated soft X-rays of 5% or more.

16. The static elimination apparatus according to claim 15, wherein the emission window is formed of at least one kind of material selected from the group consisting of Be, glass, and Al.

* * * * *